US011291239B2

(12) United States Patent
Mullen

(10) Patent No.: US 11,291,239 B2
(45) Date of Patent: Apr. 5, 2022

(54) APPARATUS AND METHODS FOR PACKING OF CIGARETTES

(71) Applicant: Patrick Michael Mullen, San Jose, CA (US)

(72) Inventor: Patrick Michael Mullen, San Jose, CA (US)

( * ) Notice: Subject to any disclaimer, the term of this patent is extended or adjusted under 35 U.S.C. 154(b) by 118 days.

(21) Appl. No.: 16/869,116

(22) Filed: May 7, 2020

(65) Prior Publication Data

US 2021/0345661 A1 Nov. 11, 2021

(51) Int. Cl.

| | |
|---|---|
| ***A24C 5/54*** | (2006.01) |
| ***A24C 5/39*** | (2006.01) |
| ***A24C 5/06*** | (2006.01) |
| ***A24C 5/35*** | (2006.01) |

(52) U.S. Cl.

CPC ..... *A24C 5/54* (2013.01); *A24C 5/06* (2013.01); *A24C 5/35* (2013.01); *A24C 5/392* (2013.01)

(58) Field of Classification Search

CPC .... A24C 3/00; A24C 5/54; A24C 5/06; A24C 1/26; A24C 5/02; A24C 5/10; A24C 5/002; A24C 5/325

See application file for complete search history.

(56) References Cited

U.S. PATENT DOCUMENTS

2019/0329514 A1* 10/2019 Holderman ..... A24C 5/06
2021/0022388 A1* 1/2021 Sullivan ..... A24C 5/54

OTHER PUBLICATIONS

Hefestus Technologies LTD, "Cone Rolling Robot Demo Live from Hefestus Technologies , Caesarea, Israel," Streamed live on Apr. 22, 2019. https://www.youtube.com/watch?v=v0gZUSf2tp8 (Year: 2019).*
Hefestus Technologies LTD, "Hefestus Cone Rolling Robot," Streamed live on Apr. 22, 2019. https://https://www.youtube.com/watch?v=zPQKkSlfcBU (Year: 2019).*

* cited by examiner

*Primary Examiner* — Niki Bakhtiari
*Assistant Examiner* — Stephanie Lynn Moore
(74) *Attorney, Agent, or Firm* — Donald R. Boys; Central Coast Patent Agency LLC

(57) ABSTRACT

A method for assembling a cigarette involves placing a cigarette starter cone in an internal cavity of a holding fixture carried on a translatable carriage at a first station, moving the carriage to a second station, loading a quantity of content into the cone at the second station by a content loading mechanism, moving the carriage to a third station, packing the loaded content in the cigarette starter cone at the third station by a packing mechanism flowing pressurized gas, moving the carriage to a fourth station, exposing the open end of the cigarette starter cone at the fourth station, clamping an exposed portion of the paper cone at the open end by a twister mechanism, activating the twister mechanism, rotating the twister mechanism at least one full turn, twisting the open end closed, and releasing the paper cone, and opening the holding fixture, releasing the packed and twisted-closed cigarette.

5 Claims, 11 Drawing Sheets

APPARATUS AND METHODS FOR PACKING OF CIGARETTES

BACKGROUND OF THE INVENTION

1. Field of the Invention

The present invention is in the field of process and packing equipment and pertains particularly to methods and apparatus for automated content loading and density packing of a cigarette cone and twisting the paper end of the packed cigarette cone.

2. Discussion of the State of the Art

In the art of automated machines, many consumer machines have been provided over the years to give the consumer convenience and a more streamlined or organized process relative to their consumption or service habits or traditions. For example, automated machines for making coffee may vary from stove top pots, to desktop brewing stations, to coffee press devices, and so on. In a sub-field of tobacco rolling products, special papers, cigarette rolling belt machines, and single cigarette dispensers are available.

A cigarette is a general term that may include any content that is wrapped into a cigarette form. Many other terms may be applied depending on the content of the paper cylinder. In the *cannabis* industry there are desktop press machines for pressing oil out of raw hemp or *cannabis*. In general, tobacco rolling products and machines are also applicable to *cannabis*, for example, being the rolled or paper packed content.

Typically, a user that rolls or packs previously made paper cylinders to make a cigarette using *cannabis* must manually close any open ends to prevent content from escaping. Tobacco may be moist enough to stay packed if rolled in a machine. However, rolling by hand does not compress the contents sufficiently to forgo closing the cigarette ends by some manner such as a manual twisting, which often includes the user depositing saliva on the twisted portion to help it retain form. The inventor is aware of an automated machine that has an automated gripping and twisting head that can detect a packed cigarette cone (slightly tapered out) or cigarette cylinder by way of an optical detection circuit.

The gripping twisting head works by rotating a main rotor to operate a cam and lever system that is connected to at least three elastomeric gripping elements. Firstly, rotation of the rotor by an electric motor operating per instructions from a micro-controller executing a firmware or software brings the three elastomeric gripping elements together around the axis of rotation to grip the paper end of the cigarette. The cam lever system is anchored on a clutch plate of a clutch assembly but driven by the rotor through interlocking pins on the clutch plate. The pins are interlocked with slots provided in the lever arms or pivot arms supporting the elastomeric gripping elements. As the rotor advances, the elastomeric gripping elements are brought together on the paper end of the cigarette to grip the paper end. Further rotation of the rotor in the same direction effects the twisting of that paper end of the cigarette. Counter rotation of the rotor then releases the twisted end of the cigarette as the gripping elements are carried back to a starting open position within the twisting head mechanism.

One challenge with rolling content using a paper wrap or packing content into a paper form is determining the correct amount and weight of content and being able to gather and present the measured content in a repeatable and economic manner. Too little content may cause a loose wrap or loose pack that is hard to keep lit while too much content may cause content density that is too high and may compromise quality and may even damage the paper form. Another challenge with packing content relates to the humidity of the content. If the content is humid it may roll and pack better than if the content were excessively dry. However, moist content may stick to paper and upset uniform content loading into a paper cone for example. If the content is dryer it may load better when packing content but may leak out if the paper end of the cigarette is not closed or twisted.

Therefore, what is clearly needed is an assembly of fixtures manipulated by robotic machine executing at least one method for enabling paper cigarette cones to be staged and packed with content and then be fashioned for secure packaging in more efficient manner requiring less biological contact than current methods.

BRIEF SUMMARY OF THE INVENTION

In one embodiment of the invention a method for assembling a finished cigarette is provided, comprising placing a pre-existing cigarette starter cone having a longitudinal axis in an internal cavity of a holding fixture carried on a translatable carriage at a first station, moving the carriage to a second station, loading a pre-measured quantity of content into the cigarette starter cone at the second station through an exposed end of the cigarette starter cone by a content loading mechanism, moving the carriage to a third station, packing the loaded content in the cigarette starter cone at the third station by a packing mechanism flowing pressurized gas, moving the carriage to a fourth station, exposing the open end of the cigarette starter cone at the fourth station, clamping an exposed portion of the paper cone at the open end by a twister mechanism, activating the twister mechanism, rotating the twister mechanism at least one full turn, twisting the open end closed, and releasing the paper cone, and opening the holding fixture, releasing the packed and twisted-closed cigarette.

In one embodiment the method further comprises a step for returning the carriage to the first station and repeating the process with another pre-existing cigarette starter cone. Also, in one embodiment the holding fixture has an internal volume shaped to accommodate the cigarette starter cone, and is separable on a plane along the longitudinal axis, such that the fixture may be opened and closed by robotically manipulated mechanisms included on the carriage, and the holding fixture is opened to place the cigarette starter cone at station 1, then closed, and is opened at station 4 to release the packed and twisted-closed cigarette. In one embodiment the holding fixture has two parts, a first part holding a major length of the cigarette starter cone, and a second part enclosing the open end of the paper cone, the two parts being openable separately by robotic mechanisms, and wherein the second part is opened at station 4, exposing the open end of the cigarette starter cone to be clamped and twisted, while the first part remains closed, holding the cigarette starter cone from rotating while the end is twisted. And in one embodiment the holding fixture comprises vacuum passages opening into the internal cavity in a matrix, such that applying vacuum to the passages holds the paper cone against inside walls of the internal cavity.

In one embodiment of the method vacuum is applied to the passages during loading at the second station to hold the paper cone open to be loaded. And in one embodiment vacuum is applied to the passages during twisting at the fourth station to hold the paper cone from rotating while the end is twisted.

In another aspect of the invention a system for assembling a finished cigarette is provided, comprising a carriage translatable between individual stations, the carriage carrying a holding fixture having an internal cavity, the internal cavity shaped to match shape of a pre-existing cigarette starter cone, a first station having a mechanism for dispensing cigarette starter cones one-at-a-time into the internal cavity of the holding fixture, a second station having a content-loading mechanism adapted for loading a pre-measured quantity of content into the cigarette starter cone through an exposed end of the cigarette starter cone, a third station having a packing mechanism flowing pressurized gas adapted for packing the loaded content in the cigarette starter cone to a desired density, and a fourth station having a twisting mechanism adapted for clamping an exposed portion of the paper cone at the open end and twisting the end closed by at least one full turn. A cigarette starter cone is loaded to the fixture at the first station, the carriage is moved to the second station, content is loaded to the cigarette starter cone at the second station, the carriage is moved to the third station, the loaded content is packed to the desired density at the third station, the open end of the cone is twisted at least one full turn at the forth station, and the packed and twisted-closed cigarette is released.

In one embodiment of the system the carriage, after a packed and twisted-closed cigarette is released is returned to the first station to start through the stations with another cigarette starter cone. Also, in one embodiment the holding fixture has an internal volume shaped to accommodate the cigarette starter cone and is separable on a plane along the longitudinal axis, such that the fixture may be opened and closed by robotically manipulated mechanisms included on the carriage. In one embodiment the holding fixture is opened to place the cigarette starter cone at station 1, then closed, and is opened at station 4 to release the packed and twisted-closed cigarette.

In one embodiment the holding fixture has two parts, a first part holding a major length of the cigarette starter cone, and a second part enclosing the open end of the paper cone, the two parts being openable separately by robotic mechanisms, and wherein the second part is opened at station 4, exposing the open end of the cigarette starter cone to be clamped and twisted, while the first part remains closed, holding the cigarette starter cone from rotating while the end is twisted. In one embodiment the holding fixture comprises vacuum passages opening into the internal cavity in a matrix, such that applying vacuum to the passages holds the paper cone against inside walls of the internal cavity. In one embodiment vacuum is applied to the passages during loading at the second station to hold the paper cone open to be loaded. And in one embodiment vacuum is applied to the passages during twisting at the fourth station to hold the paper cone from rotating while the end is twisted.

DETAILED DESCRIPTION OF THE INVENTION

Figure 1:
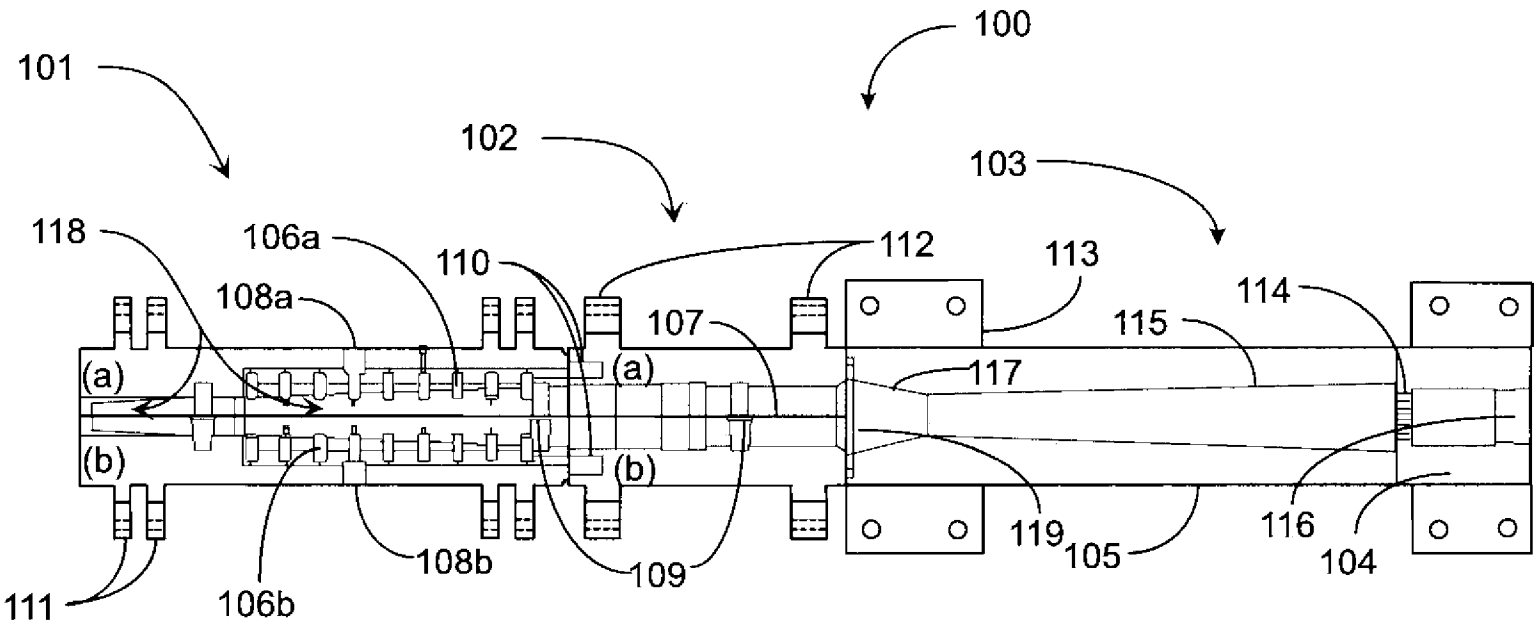
FIG. 1 is an elevation view of a fixture assembly for cigarette positioning and content loading according to an embodiment of the present invention.

In various embodiments described in enabling detail the inventor provides a unique robot-controlled fixture assembly that enables automated packing of a cigarette paper cone or cylinder. The present invention is described in enabling detail using the following examples, which may describe more than one relevant embodiment falling within the scope of the present invention.

Fixture assembly 100 is adapted as a robotically manipulated group of dedicated fixtures that are designed to fit together and may be robotically coupled and decoupled, and robotically positioned, to hold and prepare a paper or material cigarette cone, referred to in this specification as a raw paper cigarette cone, for content loading and grip-twisting the paper end before releasing the packed cigarette from the fixture assembly.

Fixture assembly 100 includes three separate fixtures that may be manipulated robotically, two of which are separable along a longitudinal plane, wherein the fixture halves may be robotically separated. Fixture assembly 100 includes a base cone staging fixture 101. Fixture 101*a* is the top half of the fixture, while fixture 101*b* represents the bottom half of the fixture. Fixture 101 may be manufactured from a durable polymeric material or stainless steel or other durable and machinable materials.

In one embodiment, the material used is a food grade material approved for contact with a consumable product. It is noted herein that the other escribed fixtures in fixture assembly 100 may be of the same materials as base cone fixture 101. Internal features in this assembled view are depicted in half-point hidden lines to preserve clarity. In one embodiment, the material used to fabricate fixture components in fixture assembly 100 may translucent although it may also be transparent or opaque without departing from the spirit and scope of the present invention.

Base cone staging fixture 101 includes fixture half 101*a* and a fixture half 101*b* joined in this view along a cut-line 107 representing interfacing flat surfaces of the fixture halves. Fixture half 101*a* and fixture half 101*b* may be removably pinned together. In this embodiment, vertical pin interfaces 109 may be provided in a symmetric pattern to enable joining together of the fixture halves in a specific relationship. Pins may be provided protruding downward from the interfacing surface of fixture half 101*b*, the pins aligned with blind openings provided in the interfacing surface of fixture half 101*b*.

In this implementation, there are four pin interfaces 109 arrayed in a rectangular pattern for fixture 101. Pins and blind openings may be provided on either interfacing surface or a combination of pins and blind openings might be provided on the interfacing surfaces without departing from the spirit and scope of the present invention. Pins may be solid stainless-steel pins with a diameter just smaller than the diameter of the blind pin openings adapted to receive them. The interfacing surfaces of the fixture halves may be machine finished to create a material seal when the fixture halves are brought together with pin interfaces 109 fully engaged.

Fixture 101 in one embodiment may have a rectangular or square end profile but may be fashioned from round stock with few modifications. Base cone fixture 101 may have mounting fins 111. Mounting fins 111 are equally distributed in a symmetrical pattern to fixture halves 101*a* and 101*b*. Openings in the longitudinal direction may be provided through mounting fins 111 to accept mounting or coupling hardware provided on a robotic unit that may control base cone fixture 101 at both fixture halves 101*a* and 101*b*. A robotic unit adapted to control movement of fixture 101 may function to place fixture halves 101*a* and 101*b* together and to separate the fixture halves. The robotic unit may also be adapted in a preferred embodiment to decouple fixture 101 in a closed state from an adjacent fixture referenced herein as base cone fixture extension 102.

Detailed enabling description of robotic fixtures adapted to manipulate the assembly of FIG. 1 is provided later in this specification.

Base cone fixture 101 may be removably coupled to fixture 102 in a closed state wherein the robotic unit may couple and decouple the fixtures. Base cone fixture 101 in a closed state has an end surface that may be machine-finished to form a material seal (flat surface both sides) with a like end surface on the interfacing end of fixture 102. Base cone fixture extension 102, like fixture 101, may also include a fixture half 102*a* and a fixture half 102*b*, separable along the same longitudinal plane as fixture 101.

Mating fixture surfaces may be electropolished or otherwise mechanically polished to achieve a very flat mating surface. Base cone fixture 101 may be coupled to fixture 102 using horizontal pin interfaces 110 arranged in a symmetrical pattern as was described with reference to vertical pin interfaces 109 used to align fixture halves 101*a* and 101*b* in assembly. At least one set of vertical pin interfaces 109 is also arranged on fixture half 102*a* and fixture half 102*b* of base cone fixture extension 102, to align the halves in assembly.

Base cone fixture extension 102 is an extension to fixture 101 and is adapted to be decoupled by robotic manipulation at the definition line 107 with fixture half 101*a* remaining coupled to fixture half 102*a* and fixture half 101*b* remaining coupled to fixture half 102*b*. Both fixture 101 and fixture 102 function to stage and to prepare a raw paper cigarette cone for content loading. Objectives and conditions for robotic coupling and decoupling of the base cone fixture 101 and fixture extension 102 and of the robotic coupling and decoupling relative to the fixture halves is provided in greater enabling detail later in this specification.

The function of base cone fixture 101 and base cone fixture extension 102, among other functions, is to enable robotic staging of an empty raw paper cigarette cone within an elongated and hollowed space 118 shared between the top (101*a*) and bottom (101*b*) half of fixture 101 and extending into the top (102*a*) and bottom (102*b*) halves of fixture extension 102. In one embodiment, base cone fixture 101 and adjacent base cone fixture extension 102 are at least somewhat transparent enabling a user to determinate optically if a paper cigarette cone is present in the fixture or if the fixture is empty, without decoupling the fixture to expose hollow space 118. Hollow space 118 has a shape that tapers somewhat to accommodate a specific cone shaped raw paper cigarette cone. In one alternative embodiment hollow space 118 may be uniform in diameter to hold and prepare a cylindrical cigarette paper for content loading.

Base cone fixture 101 includes a vacuum manifold section referenced herein as a half manifold section 106*a* on fixture half 101*a*, and a half manifold section 106*b* on fixture half 101*b*. Vacuum manifold sections 106*a* and 106*b* may include multiple and equally spaced passages that enter into hollow space 118 relative to both fixture halves 101*a* and 101*b*. Each group of air passages may connect to a single vacuum port 108*a* for half fixture 101*a* and to a single vacuum port 108*b* for half fixture 101*b*. Elongated hollow space 118 extends into base cone fixture extension 102 as well. In one embodiment, vacuum manifold 106 extends into fixture extension 102 as well but it is not required to be present in fixture extension 102 in order to practice the invention, and this extension is not shown in FIG. 1.

An important purpose of the vacuum components is to produce vacuum evacuation of fixture 101 while a raw paper cigarette cone is staged within elongated hollow space 118 to hold open the paper cone portion of the raw paper cigarette for subsequent content loading and density packing. Therefore, the volume and shape of elongated hollow space 118 is adapted to be just larger than or the same as the raw cigarette cone fully loaded with content. Fixture 102 may include mounting fins 112 to enable robotic control of the fixture relative to coupling and decoupling fixture halves 102*a* and 102*b* and coupling or decoupling from fixture 101 in a closed state. In one embodiment, there may be a gasket placed between the vertical interfacing surfaces of fixtures 101 and 102, but that is not required to practice the present invention.

Fixture assembly 100 also comprises a packing fixture 103. Packing fixture 103 is adapted to include an elongated and tapered through bore 115. Packing fixture 103 may be robotically coupled to and decoupled from base cone fixture extension 102 in a closed state. Packing fixture 103 may be in the form of a rectangular block 105 including mounting fins 113 for enabling mounting thereof to arms of a robotic unit for manipulating the packing fixture. Mounting fins 111, 112, and 113 may be contiguous material machined and drilled to form the robotic mounting points required to mount the relative fixtures to robotic controlled motion interfaces.

Packing fixture 103 may be coupled to the end of base cone fixture extension 102 when base cone extension 102 is in a closed state. The interfacing vertical surfaces between fixture 102 and content loading block 103 may be machine-finished to achieve a material surface sealing finish without using a gasket. However, in one implementation a circular O-ring gasket groove 119 is provided on the interfacing vertical surface of content loading block 103. Bore 115 extends to the vertical interfacing surface of packing 103. Packing fixture 103 includes a high-pressure nozzle 104 that may be coupled to or decoupled from block 105 and thus also includes a set of robotic mounting fins 113.

Bore 115 tapers out to a larger diameter at the interfacing surfaces of block 105 and high-pressure air nozzle 104. Nozzle 104 may include an injection head 114 adapted to connect to and couple with the interfacing vertical surface of block 105 having egress access to bore 115. Bore 115 tapers uniformly inward toward longitudinal center toward the interface with cone fixture extension 102 and begins tapering outward at a sharper angle some distance before the interface supporting gasket 119, creating a flare out feature 117.

The conical dimensions of bore 115 including the angle of inward taper over a length of the inward taper along the bore, and the angle of outward taper over a substantially shorter length of the outward taper is to control pressure applied to pack content appropriately in a loaded cigarette cone in fixture 101.

Active vacuum pumping at 108*a* and 108*b* helps to maintains open conical shape of the raw cigarette cone. After content is loaded into the cone, base cone fixture 101 may be robotically decoupled from base cone fixture extension 102 while both are in a closed state to expose the paper end of the content-loaded cigarette to be gripped and then twisted closed by a robotic-controlled, clutch-enabled grip and twist head (not illustrated) known to the inventor. This operation is described in more enabling detail below. Content may be previously measured and delivered to connected base cone fixture extension 102 and passed into a raw cigarette cone staged for loading in base cone fixture 101.

Figure 2A:
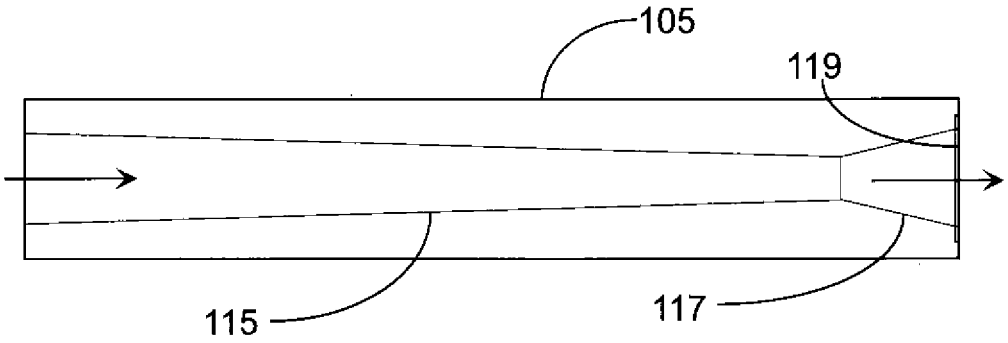
FIG. 2A is an elevation view of the content loading block of the cigarette content loading fixture of the fixture assembly of FIG. 1.

FIG. 2A is an elevation view of block 105 of packing fixture 103 of fixture assembly 100 of FIG. 1. The taper of bore 115 includes a relatively small taper-down from the ingress end of block 105 to just short of the opposite end of block 105. After the smallest diameter in bore 115, the bore becomes a uniform flare-out 117 for the rest of the distance until the bore reaches the end interfacing with base cone fixture extension 103. O-ring gasket 119 may occupy a circular groove having an outside diameter larger than the largest diameter of the flare out feature. In one embodiment, the diameter of gasket 119 may be about one inch in diameter.

The flared end 117 of bore 115 may have a diameter that may be about three-quarter inch in diameter. The smallest diameter for bore 115 may be about one quarter of an inch or so in diameter. It is noted that other dimensions may be observed without departing from the spirit and scope of the invention. The tapered shape of bore 115 is to provide air pressure and flow to compress content previously loaded into a cone loaded into.

Figure 2B:
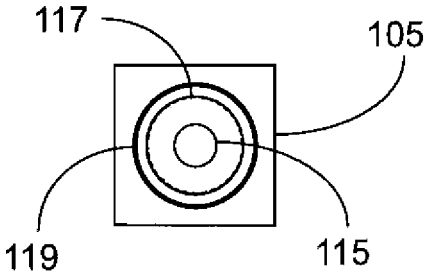
FIG. 2B is an end view of the content loading block of FIG. 2A.

FIG. 2B is an end view of block 105 of FIG. 2A. Block 105 interfaces with base cone fixture extension 102. In a preferred embodiment the raw cigarette cone may be loaded in space 118 after the fixture 101 and fixture extension 102 are separated robotically. In this embodiment, fixture assembly 100 may be held horizontally with the cigarette cone loaded manually into the lower half of the fixture assembly by an operator or loaded in robotically by a robotic dispenser mechanism. In this embodiment, gasket 119 may provide a seal between content loading block 105 and the interfacing end of base cone fixture extension 102. In one embodiment, block 105 may also include lateral pin interfacing hardware like pin interfaces 110. However, robotic machine components may be provided to align and couple block 105 to nozzle 104 and to base cone fixture extension 102 without requiring pin interfaces to hold the parts together or to align the parts properly for use.

Figure 3A:
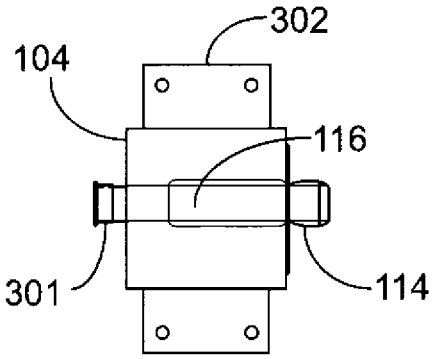
FIG. 3A is an elevation view of the air introduction nozzle 104 of the content loading fixture of the fixture assembly of FIG. 1.

FIG. 3A is an elevation view of air introduction nozzle 104 of the fixture 103 of the fixture assembly of FIG. 1. Nozzle 104 is adapted to introduce compressed air or other gas into and through bore 115 to pack content in a cone in fixture 101.

Nozzle 104 may include mounting fins 302, which may be contiguous material machined or otherwise worked to form and finish the mounting fins. An ingress nipple 301 may be provided to interface with a pressurized reusable cartridge for example. Internal bore 116 may be somewhat larger internally in diameter than ingress or egress openings. In one embodiment, a pressure valve may be provided at ingress or egress of nozzle 104.

Figure 3B:
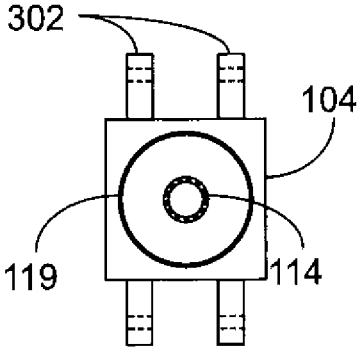
FIG. 3B is an end view of the air introduction nozzle of FIG. 3A.

FIG. 3B is an end view of air introduction nozzle 104 of FIG. 3A. Air introduction nozzle 104 includes injection head 114. Injection head 114 may be somewhat annular or ball shaped to fit a round socket recess formed at the interfacing end of bore 115. Mounting fins 302 enable robotic positioning and manipulation of nozzle 104 as a separate component. In one embodiment, ball injector head 114 connects and couples to bore 115 and gasket 119 provides an outside material seal between the block 105 and the block surface of nozzle 104.

Figure 4B:
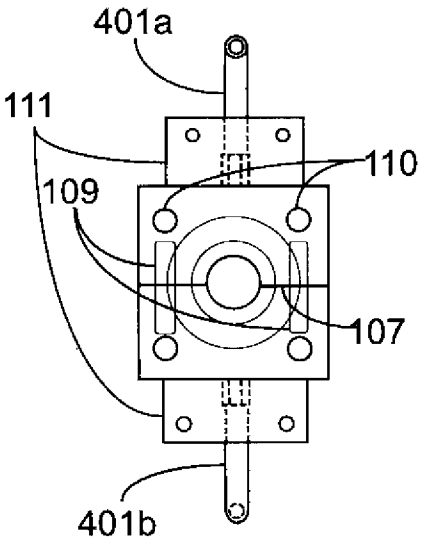
FIG. 4B is an end view of the base cone staging fixture of FIG. 4A.
Figure 4A:
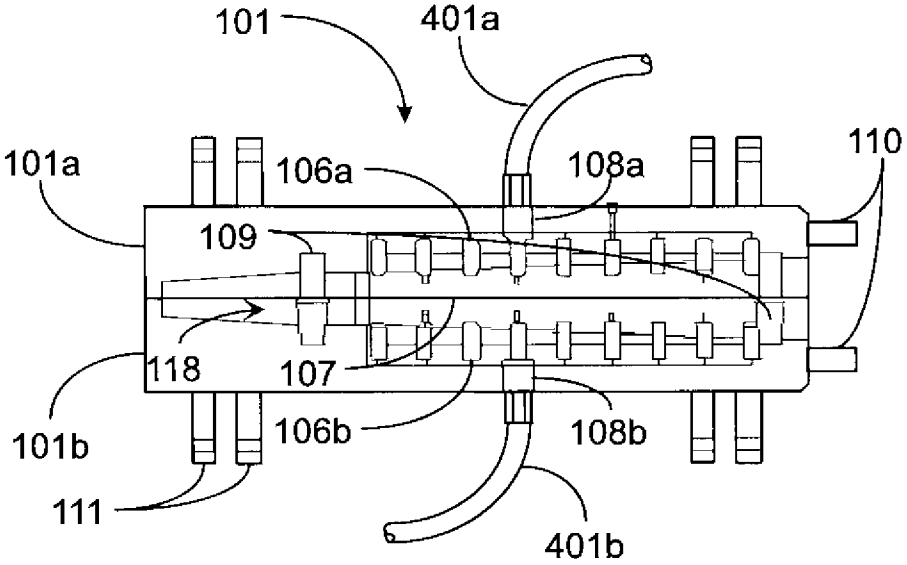
FIG. 4A is an elevation view of the base cone staging fixture of the fixture assembly of FIG. 1.

FIG. 4A is an elevation view of base cone staging fixture 101 of fixture assembly 100 of FIG. 1. Base cone fixture 101 may be separated robotically along fixture half cut-line 107 representing the interfacing surfaces of fixture halves 101*a* and 101*b*. Pin interfaces 109 help to align the fixture halves together to form fixture 101. Pin interfaces 110 provide alignment between base cone fixture 101 and the base cone fixture extension 102 (not illustrated).

Vacuum manifold structures 106*a* and 106*b* are connected to vacuum pump ports 108*a* and 108*b* respectively. A vacuum line 401*a* may be connected to vacuum port 108*a* and a vacuum line 401*b* may be connected to vacuum port 108*b*. Vacuum lines 401*a* and 401*b* may be split lines that lead to a same vacuum pump adapted to apply vacuum pressure through the lines to set up an air flow through base cone fixture 101 when it is in closed state and connected to the rest of the fixture assembly 100. Vacuum this applied over a matrix of opening in fixture 101 serves to hold the paper cone open while material is added, and also while the cone end may later be twisted to close the end of a finished cigarette.

A raw paper cigarette cone is somewhat longer than fixture 101 and when staged in the fixture extends into base cone fixture extension 102. When a previously measured amount of content is loaded it takes up most of the paper cone portion of the cone leaving a "grip" length of empty paper cone for a grip and twist head that may grab the end of the paper cone and twist it closed.

FIG. 4B is an end view of fixture 101 of FIG. 4A. Fixture 101 may be pulled apart vertically using a robotic machine adapted to decouple the fixture halves 101*a* and 101*b* at cut line 107. In one embodiment, a robotic machine may be programed by software (SW) to pull apart fixture 101 along cut-line 107 while fixture 101 is decoupled from fixture extension 102. In this embodiment, fixture 101 may, in addition, be robotically pulled apart vertically while it is coupled to base cone fixture extension 102.

When a cigarette cone has been content packed and twisted closed, base cone fixture 101 may be separated while decoupled from the rest of the fixture assembly to drop a finished cigarette into a bin or on a conveyor to a further process. In one embodiment, fixture 101 and coupled fixture extension 102 may be separated when an empty raw cigarette cone is staged for content loading.

Figure 5:
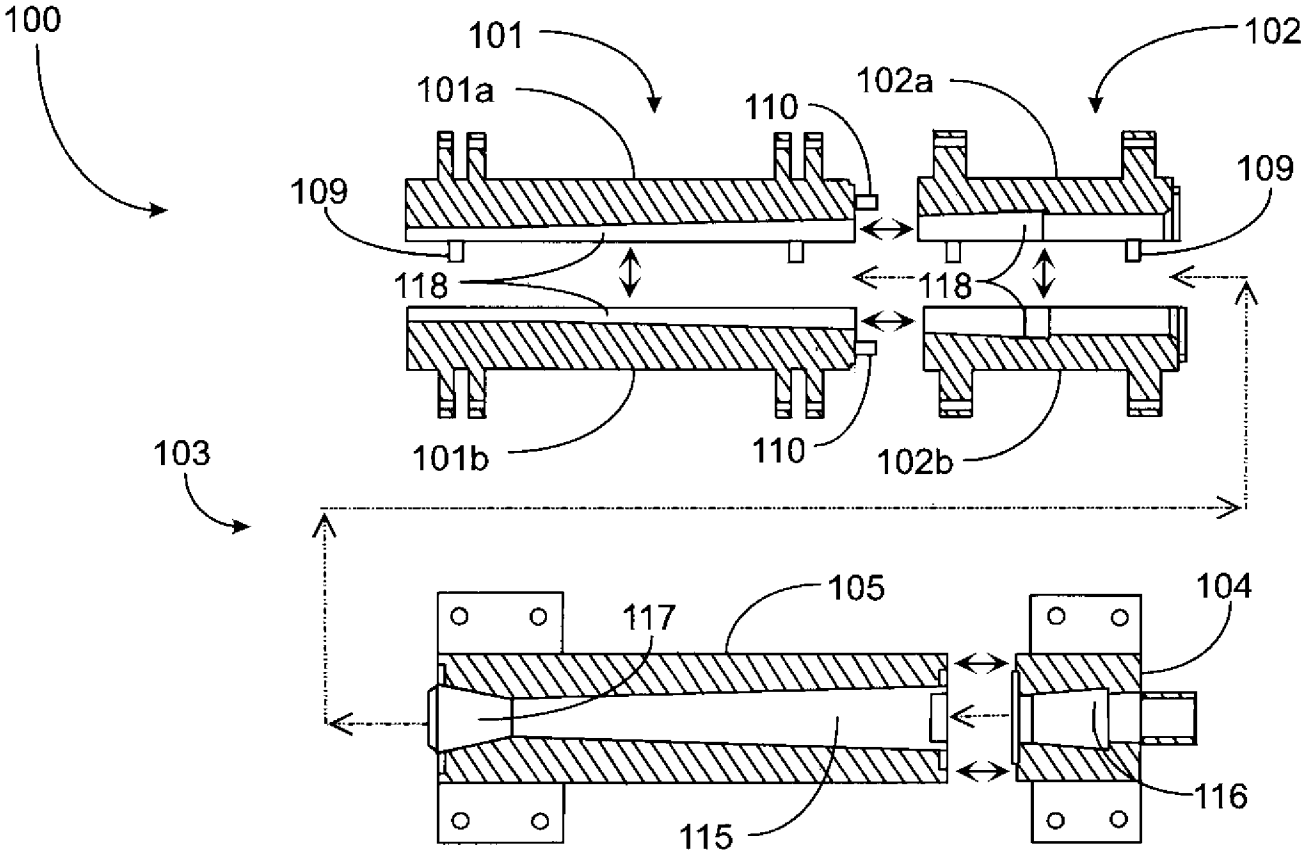
FIG. 5 is an exploded sectional view of the fixture assembly of FIG. 1 with components decoupled and vertically pulled apart according to assembly orientation.

FIG. 5 is an exploded sectional view of fixture assembly 100 of FIG. 1 with components decoupled and separated according to assembly orientation. Fixture assembly 100 includes base cone fixture 101 separated vertically into fixture halves 101*a* and 101*b* according to the directional double arrows depicted and decoupled from adjacent fixture extension 102 according to the directional double arrows depicted. Hollow space 118 has a minor diameter small enough to prevent a raw cigarette mouthpiece from moving past the staging area designated for loading the cigarette cone with content. In one embodiment, the small end of hollow 118 is closed before the block end of the fixture. A closed end may provide a convenient stop location for the mouthpiece end of the cigarette.

Hollow space 118 is conical at the same angle as a paper cigarette cone. In another embodiment, hollow 118 may be cylindrical or just slightly conical. Fixture 101 may be manipulated by a robotic machine with mounting hardware fitting to the mounting fins. Pin interfaces 109 and 110 help ensure proper alignment in assembly. Base cone fixture extension piece 102 is depicted in line with fixture 101 decoupled therefrom and separated vertically.

Figure 6:
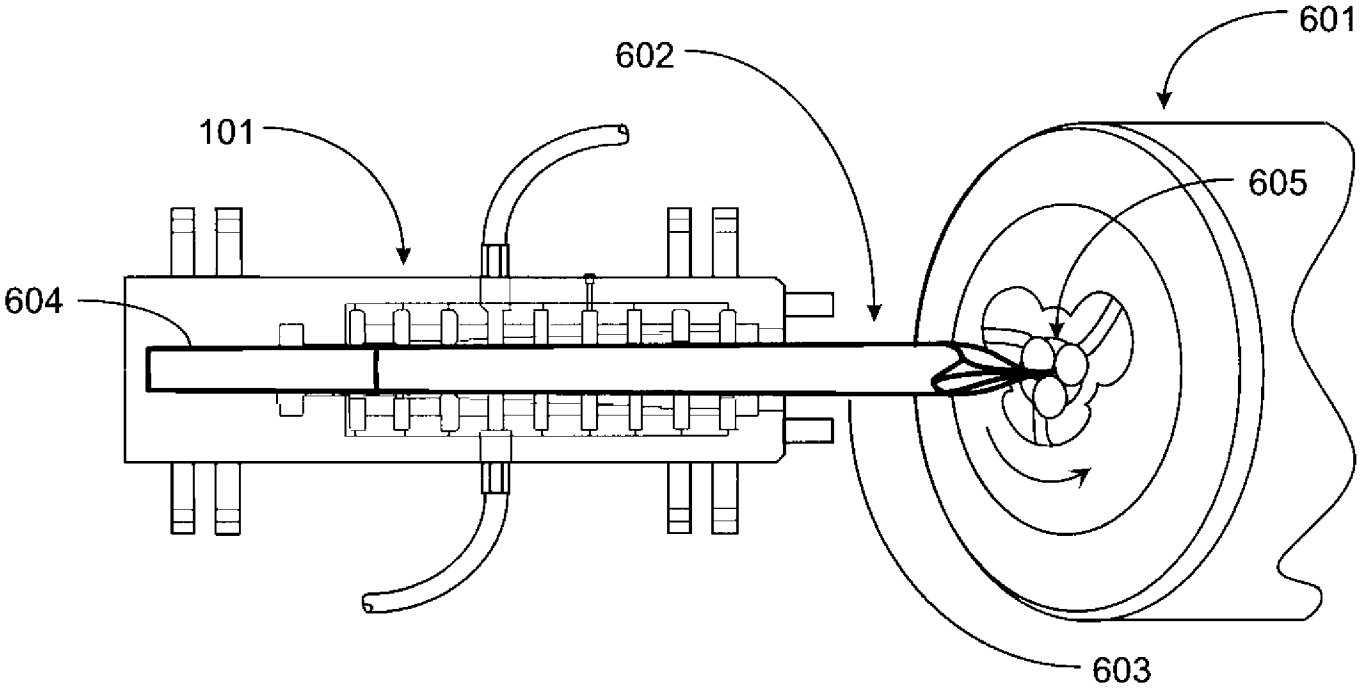
FIG. 6 is a partial elevation view of a robotic grip and twist head twisting the end of a cigarette cone staged in the base cone fixture of FIG. 1.

FIG. 6 is a partial elevation view of a robotic grip and twist head 601 twisting the end of a cigarette cone staged in base cone fixture 101 of FIG. 1. Base cone 101 contains a content-loaded cigarette cone 602 having a mouthpiece 604, and a paper cone 603. In this implementation, cigarette cone 602 is exposed by robotic uncoupling of the base cone fixture extension 102. A significant length of cone portion 603 of cigarette 602 is thus exposed.

In one embodiment, grip and twist head 601 is held in a stationary position and the robotic machine provides directed machine manipulation of base cone fixture 101 to bring the paper end of cigarette cone 602 into an aligned position to be gripped and twisted by grip and twist head 601. In one embodiment, the base cone fixture may be subjected to vacuum while a content-filled cigarette is being twisted to prevent spin of the cone in the fixture space and possible damage to the paper such as a tear or puncture.

Figure 7B:
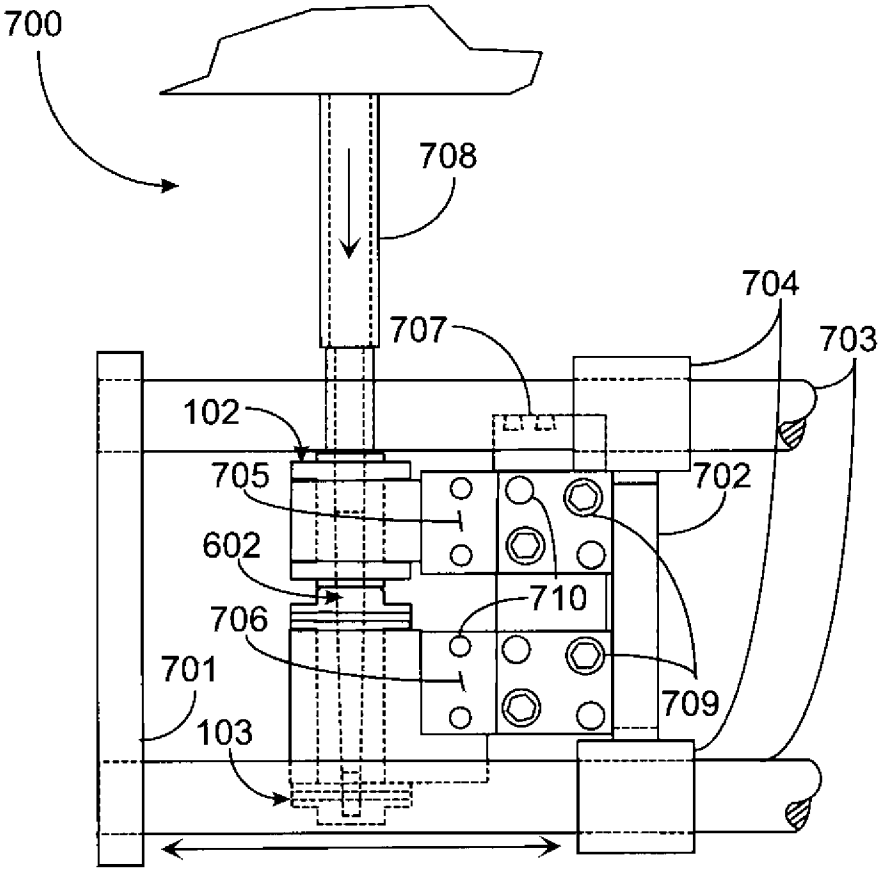
FIG. 7B is a side elevation view of the robotic machine process of FIG. 7A.
Figure 7A:
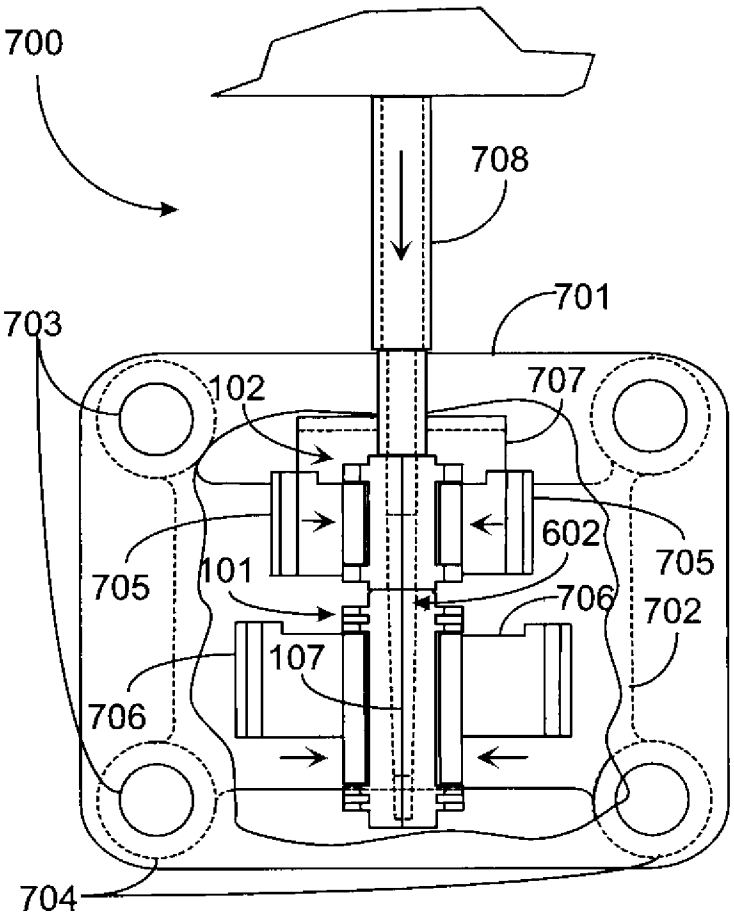
FIG. 7A is a front elevation view of a robotic machine in process of staging a raw cigarette cone into the base cone staging fixture of FIG. 1.

FIGS. 7A and 7B illustrate front elevation views at ninety degrees of a robotic machine 700 used in a process of staging a raw cigarette cone into base cone staging fixture 101 of FIG. 1. Fixture assembly 100 and the sub elements of the assembly require robotic machine assistance and process as briefly described above. The process using robotic machine 700 involves a first step of dispensing a raw paper cigarette cone, such as cone 602 of FIG. 6, into base cone staging fixture 101 before content loading.

In this implementation, a robotics machine configuration is provided to align and manipulate fixture assembly 100 in cigarette packing processes wherein the assembly is decoupled to include base cone fixture 101 and base cone fixture extension piece 102 for staging a raw cigarette cone. The robotic machine includes a configuration of parallel rails arranged symmetrically and defined by individual travel rails 703. In this example there are four travel rails 703 that provide a travel path. A rear vertical support plate 702 is provided that has four rail travel rail seats 704 formed near corners of the plate. Travel rail seats 704 are formed at the four corners of plate 702 and are adapted, in this example, in orientation and inside diameter of the seats to fit over travel rails 703 to enable rear vertical support plate 702 travel in a snug-fit manner back and forth along rails. In some embodiments there may be journal bearings or ball bearings in the rail seats of plate 702. Plate 702 provides a carriage that may be translated along the rails to successive stations where successive operations may be performed to finish a cigarette. In further description element 702 is referred to as a carriage that travels along the rails.

Rails 703 in this example terminate at a front vertical stop plate 701. Plates 701 and 702 may be galvanized steel plates, aluminum plates, or another metal that may be rated for food grade application. Plate 701 is shown with a broken-out section in FIG. 7A to show the robotic components mounted to base cone fixture 101 and fixture extension 102. Carriage 702 supports a pneumatically operated control housing 707 mounted to the inside face of the carriage roughly centered within the rail pattern defined by travel rails 703.

Control housing 707 may be adapted to contain pneumatic components including pneumatic cylinders (not illustrated). The pneumatic cylinders may be attached at one end to robotic arms. In this implementation, a pair of diametrically opposed robotic arms 705 are provided that may be controlled by pneumatics to move along the x-axis in this view.

Robotic arms 705 include a right robotic arm and a left robotic arm. For each arm there is a back plate fixed to the pneumatic cylinders and running parallel with travel rails 703, an extension plate fixed to the back plate parallel to plates 701 and 702, and a mounting plate that attaches to one side of base cone fixture extension 102, the mounting plate attached to the mounting fins at both ends of extension 102. A second pair of diametrically opposed robotic arms 706 is provided and connected to base cone staging fixture 101 and to pneumatic cylinders running parallel with plates 701 and 702 contained within housing 707.

The state of fixture positioning is closed and coupled in this view. Staging fixture 101 and extension 102 separate at cut line 107 as described and detailed in examples above. Fixtures 101 and 102 may also be decoupled vertically via a pneumatic cylinder mounted vertically within housing 707 and installed between horizontal cylinders controlling movement along the rails in this view. Robotic arms 705 and 706 are closed in this example holding fixture and extension halves together along cut line 107. The inner hollow space referred to as space 118 in FIG. 1 is depicted by broken lines.

A raw cigarette cone 602 is referenced within the base cone staging fixture, having been deposited into the hollow space 118. In one embodiment the robotic arms open the opposite halves 101*a* and 101*b* and a placement mechanism 708 lowers a cone into position, and the robotic arms than close parts 101*a* and 101*b*. In a preferred implementation, dispensing apparatus 708 has access to a plurality of raw cigarette cones and a capability of dispensing one cigarette cone at a time into base cone staging fixture 101. Horizontal broken lines define the top of the dispensed raw cigarette cone and the junction between the mouthpiece of the cone and the paper portion to be filled with content.

FIG. 7B is a side elevation view of the robotic machine process of FIG. 7A. In this view travel rails 703 are seen to support carriage 702 and pneumatic housing 707 hosting robotic arms 705 and 706 in travel back and forth along the rails. Rails 703 may be fixed or seated into a larger bank that may also include an overhead extension housing adapted to stage vertical tools like cigarette cone dispenser apparatus 708. Carriage 702 may be connected to a linear motor or to a pneumatic cylinder (not illustrated) mounted at the rear of the plate. To move the carriage to and from successive positions along the rails.

Back plates of robotic arms 705 and 706 are mounted in this implementation to a pair of pneumatic cylinders 709 controlled to extend and retract orthogonally to the direction of travel rails 703 out from the sides of pneumatic housing 707. Robotic arm plates comprising robotic arms 705 and 706 may be fastened or bolted together at bolt locations 710 using conventional hardware.

Base cone staging fixture 101 and coupled extension piece 102 may be held closed and may be urged toward vertical stop plate 701 to a align the top opening of base cone extension 102 with the nozzle opening of dispenser apparatus 708 in order to receive a raw paper cone into the fixture hollow space. In one implementation, a mechanical stop may be provided on one or more rails 703 or adjacent to the rails 703 to stop forward travel of the carriage at a point of alignment with apparatus 708.

In another implementation a linear motor may be used to drive carriage 702 to an alignment point with apparatus 708. The motor may be a stepper motor, and the process may be software controlled.

Figure 8:
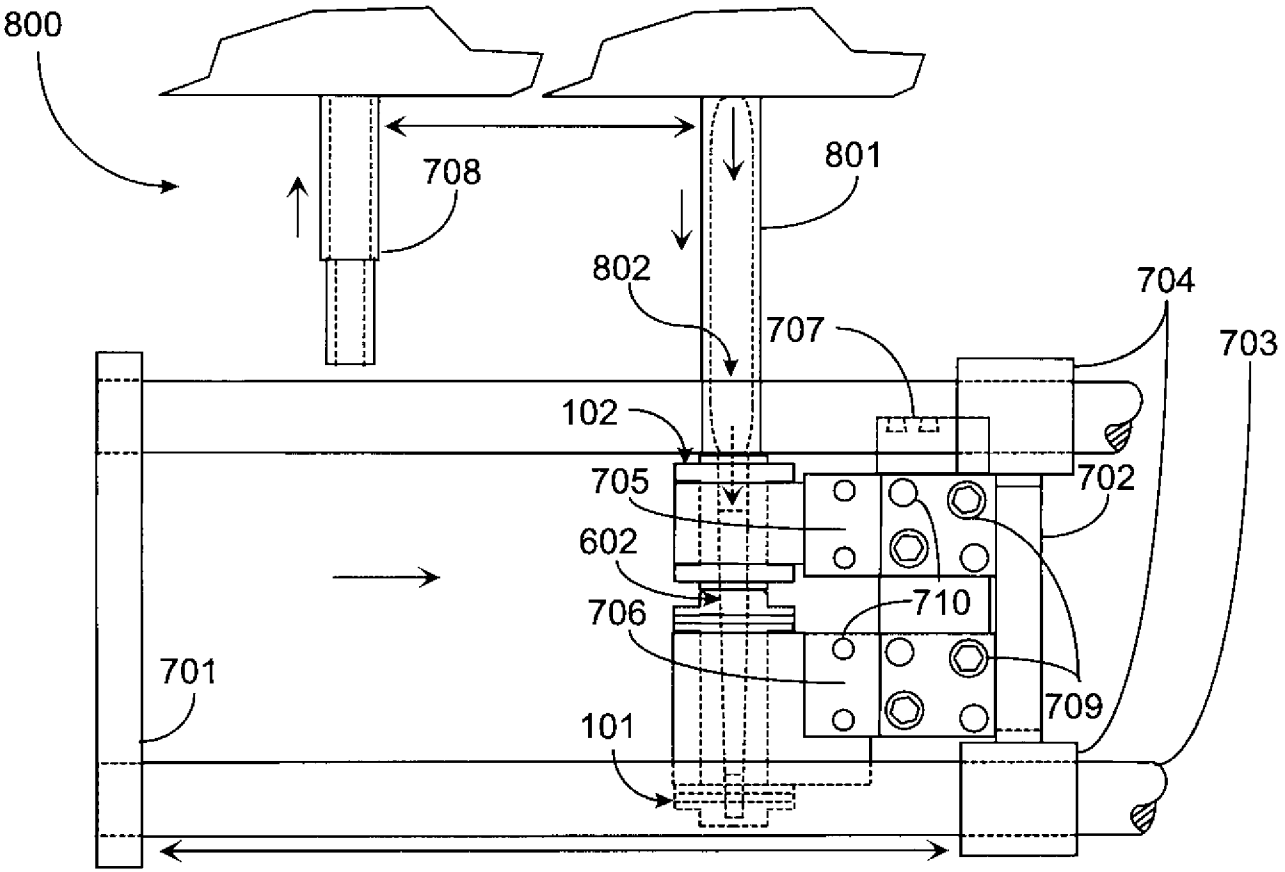
FIG. 8 is a side elevation view of a robotic machine process for distributing a measured amount of content into the raw cigarette cone staged in FIG. 7B.

FIG. 8 is a side elevation view of carriage 702 moved to a second station 800 for loading content, such as *cannabis* or tobacco, into the loaded cigarette paper cone. The process at station 800 represents a second step after dispensing a paper cone as depicted in FIGS. 7A and 7B. A content dispensing apparatus 801 is depicted as apparatus to dispense content into the cigarette cone staged in fixture 101. Content dispensing apparatus 801 may raised and lowered at this second station to connect to the loading fixture.

Robotic arms 705 and 706 remain closed in process 800 holding fixture 101 and coupled extension 102 closed along the cut line 107 of FIG. 7A. Content dispensing apparatus 801 may have access to an aggregate of content wherein the internal hollow space of the nozzle 801 has a volume defined to hold an appropriate measured amount of content 802 to disperse into a cigarette cone. In other embodiments a measured quantity is first placed in apparatus 801, which than dispenses to the paper cone.

In one embodiment, content dispensing tool 801 may use low pressure air flow air to move content from a chamber internal to apparatus 801 through the top opening of extension piece 102 and into cigarette cone 602. In one embodiment vacuum lines are provided to each base cone fixture half as described previously in FIG. 6. In this way, the paper cone portion of the raw cigarette cone may be held open while material is dispensed.

Apparatus 801 may be used to dispense content at least loosely into the hollow space within fixture 102 containing the staged cigarette cone 602 prior to a next process of pneumatically packing the dispensed content 802 into the staged cigarette cone with high pressure air or other gaseous material.

Figure 9:
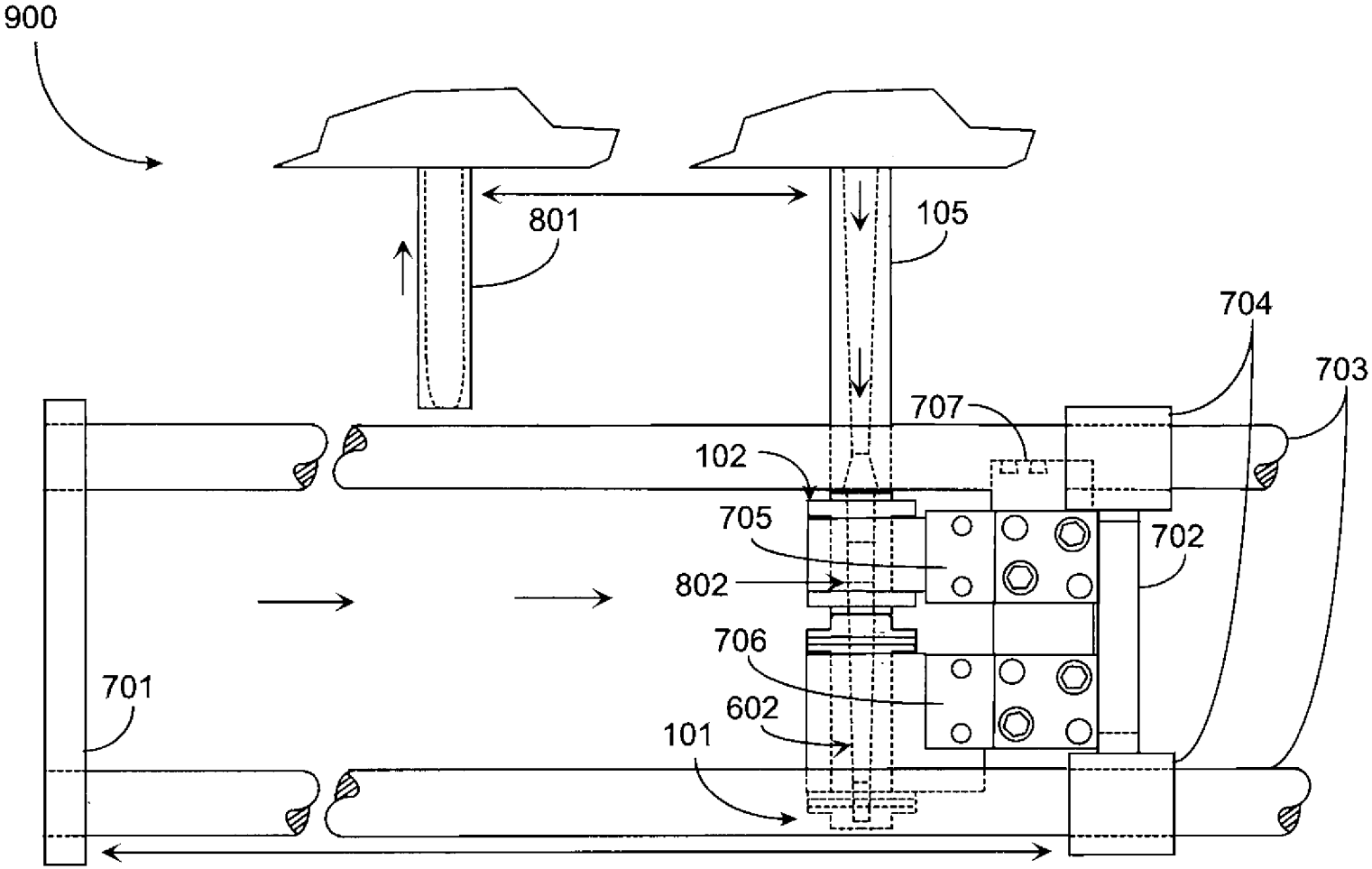
FIG. 9 is a side elevation view of a robotic machine process for pneumatically packing the content distributed into the raw cigarette cone in the process of FIG. 8.

FIG. 9 is a side elevation view of the carriage at a third station 900 adapted for pneumatically packing the content loaded into the raw cigarette cone in the process of FIG. 8. In this embodiment, a content packing apparatus. described previously with reference to FIG. 1 is used to pack the content material to an appropriate density for the finished cigarette.

In process 900, content is present in cigarette cone 602 having been previously dispensed via content dispensing apparatus 801. An air nozzle (not detailed) like nozzle 104 of FIG. 1 may be used to deliver one or more air bursts, which may also involve a stream of steady air flow through block 105 to pack the content in cone 602 to a desired density.

Cone 602 extends well into fixture extension 102. A broken line 802 (content) is depicted across paper cone 602 and represents the fill line of the measured and packed content. Fixture 101 and extension 102 remain coupled and closed during content loading and content packing The gradual conical shape of the vertical bore of block 105 is described above in enabling detail. The bore narrows down within block 105 to the point of junction with the flare out feature. This serves to direct the air through the smallest cone diameter proximal to extension piece. The flare out feature helps to evenly direct the pulsed or streamed air into fixture extension 102 and into cigarette 602 staged within fixture 101. In one embodiment, a pneumatic controller (not illustrated) may be provided, that hosts a programmable software (SW) that may be programed by a user. Other Robotics mechanisms such as optical or beam-based trigger mechanisms (not illustrated) may also be provided to trigger certain process steps without departing from the spirit and scope of the present invention.

Figure 10:
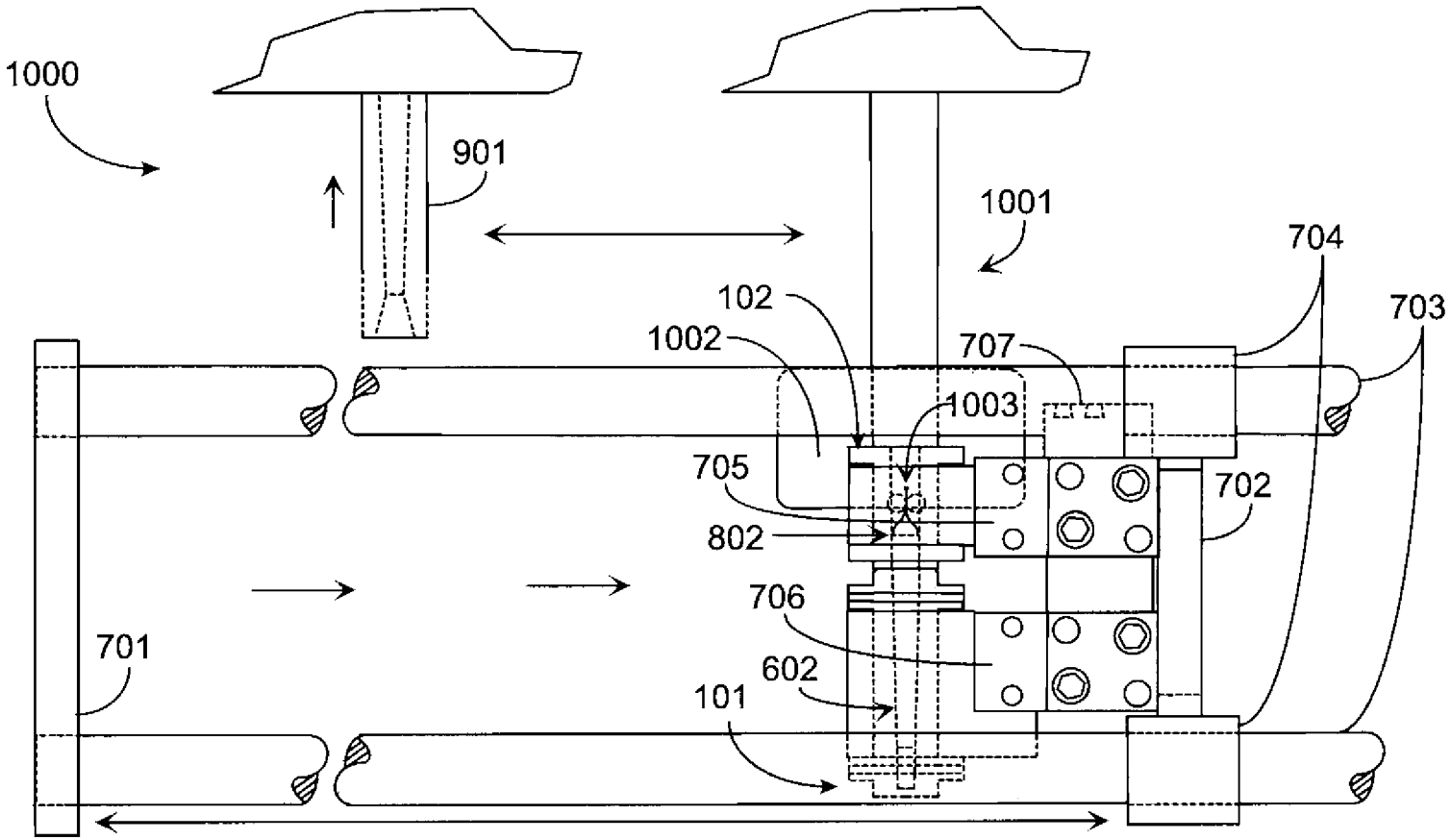
FIG. 10 is a side elevation view of a robotic machine process of gripping and twisting closed the end of the packed raw cigarette cone of FIG. 9.

FIG. 10 is a side elevation view of a subsequent station 1000 for gripping and twisting closed the end of the packed raw cigarette cone of FIG. 9. At this stage of the overall process robotics directed decoupling of fixture extension 102 from base cone staging fixture 101 is required. The robotic movements described make way for a clutch-assisted gripping and twisting tool 1001 known to the inventor. Tool 1001 may be raised and lowered and is lowered in this process In the robotic sequence, robotic arms 705 may be directed to move vertically upward a limited distance, the distance enough to effect decoupling of the elements (base fixture 101 and extension 102). Robotic arms 705 may, after decoupling, be directed to move apart to pull the pinned extension halves of fixture extension 102 apart at the cut line. The separation distance required between the robotic controlled halves may be dependent on the outside diameter of a grip twist head 1002. The separation of fixture 102 exposes the paper upper end of the filled cigarette cone.

Grip and twist head 1002 may be centrally mounted to or otherwise fitted to a shaft that is hollow to provide power and mechanics such as a stepper motor, linear motor, or other motor adapted for the operation. Grip and twisting head 1002 may include a gripping mechanism 1003 comprising three relatively small elastomeric balls mounted to mechanical levers having a mounted position on a clutch plate.

The paper end of cigarette cone 602 extends past the upper edge of fixture 101, which remains closed during this process. In one embodiment, cigarette cone 602 is made to remain motionless inside base cone staging fixture 101 through application of vacuum so that twisting does not rotate the cigarette within the fixture hollow. In one embodiment, grip and twist head 1002 may host an optical or laser trip mechanism mounted to bridge a central opening in the bottom face of the twist head, the trip mechanism connected to the motor controller for initiating a grip and twist sequence. Twisting may involve two to several rotations of the mechanism 1003 to close a filled and packed cigarette 602.

Figure 11:
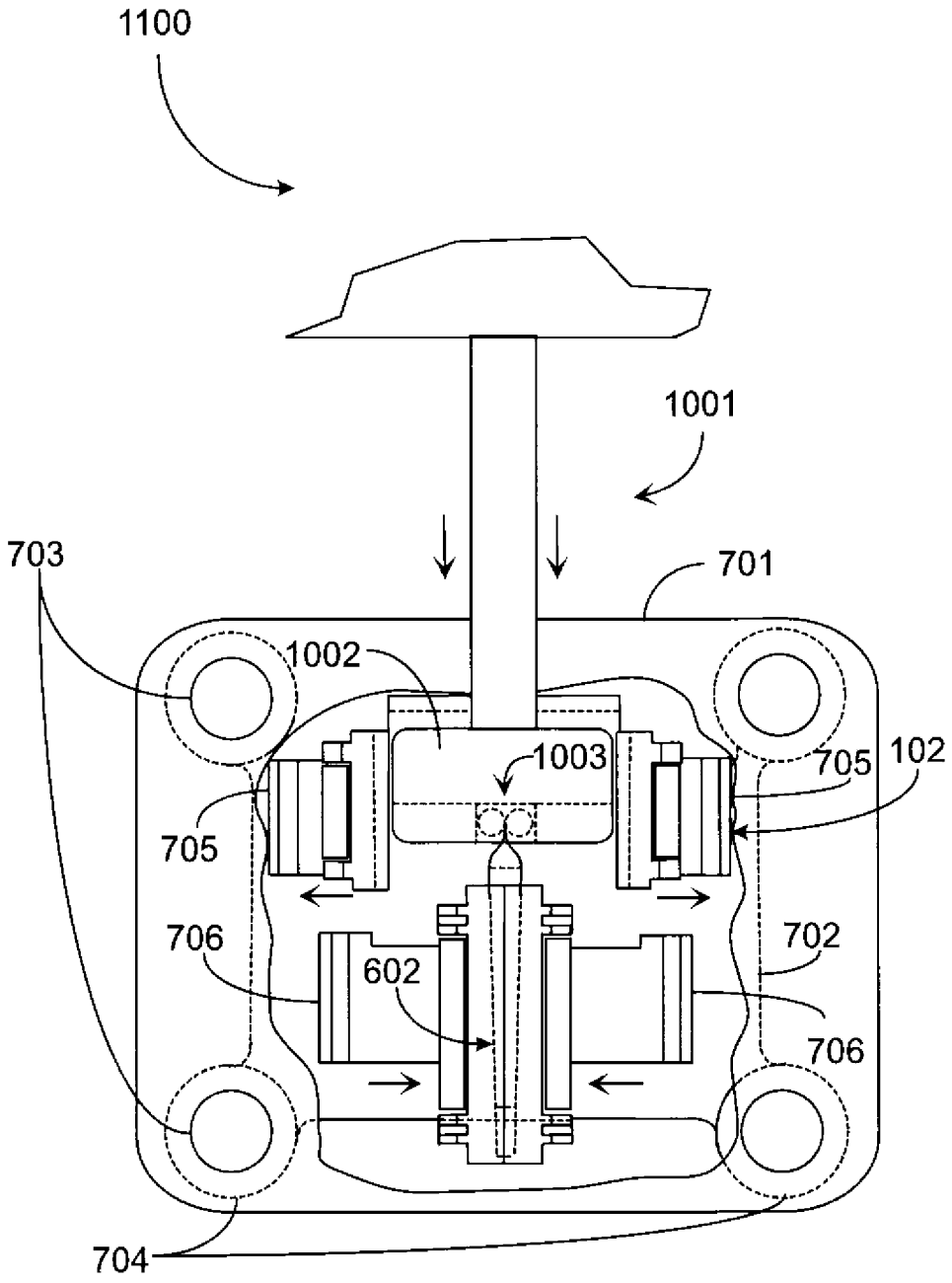
FIG. 11 is a front elevation view of the robotic machine process of FIG. 10.

FIG. 11 is a front elevation view of the robotic machine process 1000 of FIG. 10. In this end view like view 7A, a portion of material is removed from front vertical stop plate 701 for the purpose of clarity in depiction. Grip-and-twist head 1002 has position between the extension halves of fixture extension 102, which are mounted to robotic arms 705. Robotic arms 705 mounted to extension halves of extension 102 separate from centerline 107 to a distance enough to enable tool 1001 to lower from a raised position according to the downward arrows adjacent to the shaft of the tool.

Grip-and-twist head 1002 has access to the open end of cigarette 602 in the space created by separating the extension halves of fixture extension 102. Base cone staging fixture 101 remains closed holding cigarette 602 having been filled with content, packed to a density value and twisted to close.

Figure 12:
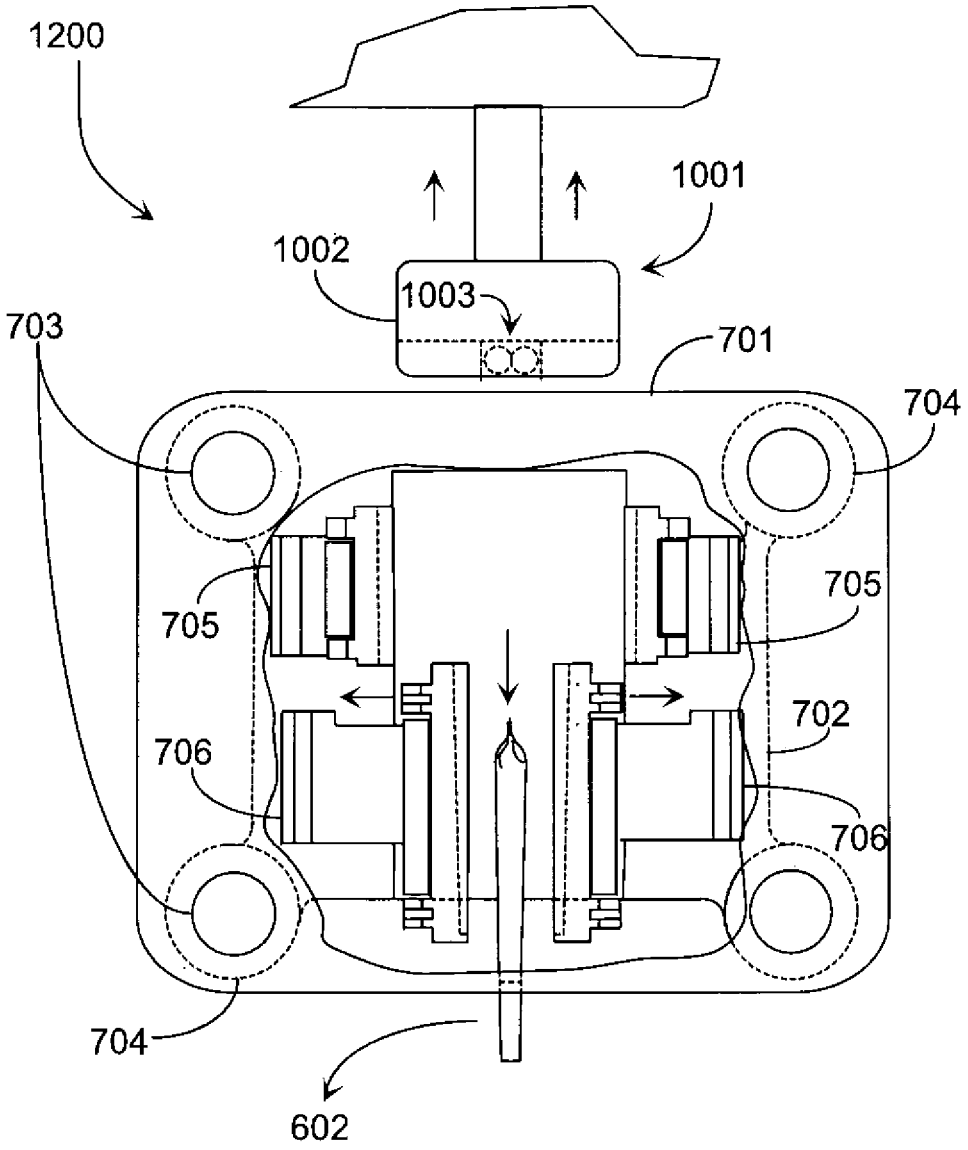
FIG. 12 is a front-elevation view a robotic machine process of ejecting a packed cigarette from the cigarette cone staging fixture.

FIG. 12 is a front-elevation view of a process 1200 of ejecting a packed cigarette from the base cone fixture. A broken section of front vertical stop plate 701 allows the internal elements to be shown. In this process, twist and grip tool 1001 is opened and raised upward for clearance. Base cone staging fixture 101 may be separated by robotic arms 706 in the direction of the arrows at any time after the twist and grip sequence has been performed and the grip and twist tool 1001 has been raised or is in the process of being retracted. Finished cigarette 102 may be released from the staging space and may fall into a bin or onto a conveyor to travel to a next commercial process like quality control inspection and packaging processes.

Carriage 702 may be bought back linearly to the first station (FIG. 7A) over travel rails 703 after cigarette 602 is ejected from the fixture halves of fixture in preparation for receiving a next raw cigarette cone for pneumatic and mechanical processing summarized in that a raw cone is staged, stabilized, filled, packed, twisted at the end, and ejected from the fixture assembly.

One with skill in the art of robotics will understand that in one embodiment, the fixture assembly mounted to the robotic arms supported by the pneumatic mounted to the rear vertical support plate may remain fixed or stationary in position during the whole process. One with skill in the art of robotics will recognize that the tools presented to perform tasks such as inserting the cone, filling the cone, packing the cone, and twisting the cone, may be mounted to a rotatable ceiling table overhead, or an overhead track system also controlled by pneumatics where the tools may be indexed and rotated into a single vertical position aligned with the fixed position of the fixture assembly and robotic mechanism manipulating them. Vertical retraction of tools upward after task and vertical extension of tools downward to perform task may be pneumatically controlled.

It will be apparent to the skilled person that the cigarette packing system of the invention may be provided using some or all the mentioned features and components without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention. The invention is limited only by the breadth of the claims below.

The invention claimed is:

1. A method for assembling a finished cigarette, comprising:

placing a pre-existing cigarette starter cone having a first end for a mouthpiece and a second, open end and a longitudinal axis in an internal cavity of a two-part holding fixture having a first portion separable along a longitudinal central plane and enclosing a first length of the cigarette starter cone from the first end, and a second portion also separable along the longitudinal central plane enclosing a second length of the cigarette starter cone including the second open end, the two-part holding fixture carried on a translatable carriage at a first station;

moving the carriage to a second station, holding the cigarette starter cone open in the two-part holding fixture by applying vacuum on a matrix of openings along the lengths of the two portions of the holding fixture;

loading a pre-measured quantity of content into the cigarette starter cone at the second station through the second, open end of the cigarette starter cone by a content loading mechanism;

moving the carriage to a third station;

packing the loaded content in the cigarette starter cone at the third station by flowing pressurized gas into the second, open end of the cigarette starter cone against the loaded content;

moving the carriage to a fourth station;

opening the second portion of the holding fixture along the longitudinal central plane, exposing the second length of the cigarette starter cone including the second, open end;

clamping the exposed portion of the cigarette starter cone at the second, open end by a twister mechanism, activating the twister mechanism, rotating the twister mechanism at least one full turn, twisting the open end closed;

releasing the twister mechanism from the cigarette paper cone; and opening the first portion of the cigarette holding fixture, releasing the finished cigarette.

2. The method of claim 1 further comprising a step:

returning the carriage to the first station and repeating the process with another pre-existing cigarette starter cone.

3. The method of claim 1 wherein the two-part holding fixture has an internal volume shaped to accommodate the cigarette starter cone, and both portions are separable on a plane along the longitudinal axis, such that the portions may be opened and closed by robotically manipulated mechanisms included on the carriage, and the holding fixture is opened to place the cigarette starter cone at station 1, then closed, and is opened at station 4 to release the packed and twisted-closed cigarette.

4. A system for assembling a finished cigarette, comprising:

a carriage translatable between individual stations on a set of straight, parallel rails passing through bearings set in the carriage;

a holding fixture having an internal cavity shaped to match a shape of a pre-existing cigarette starter cone, the holding fixture having a first portion separable along a longitudinal central plane into two parts, the first portion enclosing a first length of the cigarette starter cone from a first end, and a second portion also separable along the longitudinal central plane into two parts, the second portion enclosing a second length of the cigarette starter cone including the second open end;

a robotic mechanism adapted to open and close the two parts of the first and second portions of the holding fixture individually;

a vacuum apparatus applying vacuum to a plurality of openings into the internal cavity through each of the parts of each of the portions of the holding fixture;

a first station having a mechanism for dispensing the cigarette starter cones one-at-a-time into the internal cavity of the two-part holding fixture;

a second station having a content-loading mechanism adapted for loading a pre-measured quantity of content into the cigarette starter cone through the second, open end while the cigarette starter cone is held open by the vacuum apparatus;

a third station having a packing mechanism flowing pressurized gas into the second, open end of the cigarette starter cone; and a fourth station having a twisting mechanism adapted for clamping an exposed portion of the cigarette starter cone at the second, open end and twisting the open end closed by at least one full turn while the cigarette starter cone is held open by the vacuum apparatus;

wherein the cigarette starter cone is loaded to the internal cavity of the holding fixture at the first station by opening the first and the second portions together by the robotic mechanism, then closing the first and second portions together, the carriage is moved to the second station, content is loaded to the cigarette starter cone at the second station through the second, open end while the cigarette starter cone is held open by the vacuum apparatus, the carriage is moved to the third station, the loaded content is packed to the desired density at the third station by injecting pressurized air into the second, open end, the robotic mechanism is used to open the second portion of the two-part holding fixture, exposing a length of the cigarette starter cone at the second, open end, the open end of the cigarette starter cone is gripped by the twisting mechanism and twisted at least one full turn at the fourth station while the cigarette starter cone is held open by the vacuum apparatus, and the robotic mechanism opens the first portion of the two-part holding fixture and the packed and twisted-closed cigarette is released.

5. The system of claim 4 wherein the carriage, after a packed and twisted-closed cigarette is released, is returned to the first station to start through the stations with another cigarette starter cone.

* * * * *